United States Patent [19]

Kallinich et al.

[11] Patent Number: 4,919,170

[45] Date of Patent: Apr. 24, 1990

[54] FLOW DUCT FOR THE FLUE GAS OF A FLUE GAS-CLEANING PLANT

[75] Inventors: Dietmar Kallinich, Gelsenkirchen; Wolfgang Hahlert; Peter Thom, both of Castrop-Rauxel, all of Fed. Rep. of Germany

[73] Assignees: Veba Kraftwerke Ruhr Aktiengesellschaft, Gelsenkirchen-Buer; Flachglas Aktiengesellschaft, Furth, both of Fed. Rep. of Germany

[21] Appl. No.: 230,277

[22] Filed: Aug. 5, 1988

[30] Foreign Application Priority Data

Aug. 8, 1987 [DE] Fed. Rep. of Germany ..... 3726492

[51] Int. Cl.[5] ..... F15D 1/04

[52] U.S. Cl. ..... 138/39; 428/410

[58] Field of Search ..... 138/37, 39; 137/615; 428/409, 410, 913; 65/21.1, 21.4, 90, 91, 93, 94, 375; 52/306

[56] References Cited

U.S. PATENT DOCUMENTS

| | | | |
|---|---|---|---|
| 1,974,109 | 9/1934 | Higley | 138/39 |
| 2,667,185 | 1/1954 | Beavers | 138/37 |
| 2,826,221 | 3/1958 | Speiser | 138/39 |
| 3,494,379 | 2/1970 | Hinden | 138/39 |
| 4,232,710 | 11/1980 | Gallo et al. | 138/39 |
| 4,360,432 | 11/1982 | Kieronski | 138/39 |

FOREIGN PATENT DOCUMENTS

3726492C1 10/1988 Fed. Rep. of Germany .

OTHER PUBLICATIONS

Zum Stand der Tafelglastechnologie, Wolf-Dieter Hamisch, Silikattechnik 35, (1984), Heft 7, pp. 200–204.

Neuheiten-Markt (Ausser Veraniwortung der Redaktion), Einscheiben-Sicherhettsglas (ESG) Bi-Vetral glas+rahmen 21/1983, pp. 1133 and 1134.

Verfestigung von Flachglas Durch Ionenaustausch im Geschmolzenen KNO3, Vladimir Novotny, Staatliches Glasforschungsinstitut Hradee Kralove/CSSR, Silikattechnik 38, (1987), Heft 1, pp. 28–30.

*Primary Examiner*—James E. Bryant, III

*Attorney, Agent, or Firm*—Herbert Dubno

[57] ABSTRACT

The flow duct for flue gas to be treated and/or treated in an flue gas cleaning unit or plant has a plurality of flow guide elements, particularly in the vicinity of an elbow or a knee of the flow duct. The flow guide elements have curved flow guide surfaces and comprises self-supporting glass panes. The glass panes themselves can be prestressed and/or subjected to a compressive prestressing.

6 Claims, 3 Drawing Sheets

FLOW DUCT FOR THE FLUE GAS OF A FLUE GAS-CLEANING PLANT

FIELD OF THE INVENTION

Our invention relates to a flow duct for the flue gas treated and/or to be treated in an flue gas cleaning plant.

BACKGROUND OF THE INVENTION

Flow ducts for flue gas can include flow-distributing elements or baffles, especially in the vicinity of an elbow or a bend having flow guide surfaces.

These flow ducts for the flue gas of an flue gas cleaning plant can be located downstream of a boiler furnace, especially a power plant.

The flow ducts are usually made of sheet metal and have primarily a rectangular or a square flow duct cross section.

In this description of our invention, the term "flow duct" and similar terms not only mean a conducting pipe, but also flow equipment and equipment parts, especially admission equipment for the gas to be cleaned and discharge equipment for the cleaned gas from the wash tower for the wet flue gas cleaning.

In the wet flue gas cleaning of the flue gas downstream of the boiler furnace, special requirements characterize the flow guide elements. On the one hand, the flow guide elements have increased requirements in regard to mechanical considerations related to resistance to creep, also to thermal stress due to temperature changes. On the other hand, the flow guide elements must significantly resist chemical and electro-chemical corrosion which occurs because the flue gas to be cleaned, also that which has been cleaned, travel with corrosive components.

Abrasive action occurs because the above-named flue gas entrains fine solids, which also tend to deposit on the flow guide surfaces which again can lead to formation of corrosion-promoting microelements.

Finally, the flow resistance of the flow guide elements must be sufficiently small to avoid unnecessary energy losses.

In the known flow duct of the above-described structure and purpose, the flow guide elements are made of sheet metal. Because of the corrosive action, high grade austenitic chromium sheet metal or chromium/nickel sheet metal is used. The operational lifetime is nonetheless unsatisfactory. It is frequently under 2000 operating hours. The surface roughness is comparatively large. Because of the relatively high surface roughness, the flow resistance is disturbingly large, and the rough surface promotes the deposition of the solid components from the gas.

Furthermore, an electric potential acting corrosively is established between the flow guide elements of the comparatively noble alloy components and the metallic material of the flow duct which primarily is made of structural steel.

To improve the operational life of the duct, it is known to coat the flow guide elements with a protective layer made of polytetrafluoroethylene, for example, or some other material. However, experience has shown that those expedients do not lead to noteworthy improvement of the operational lifetime of the flow guide elements.

OBJECT OF THE INVENTION

It is an object of our invention to provide an improved flow duct for flue gas of an flue gas cleaning plant or unit in which the flow guide elements are characterized by a practically unlimited operational lifetime and a slight flow resistance.

SUMMARY OF THE INVENTION

These objects and others which will become more readily apparent hereinafter are attained, in accordance with our invention, in a flow duct for flue gas of a flue gas cleaning plant or unit which is to be treated or has been treated having a plurality of flow guide elements, particularly in the vicinity of an elbow or a knee, i.e. a bend.

According to our invention, the flow guide elements comprise self-supporting curved glass panes. Our invention can preferably utilize the sheet glass used normally for plate glass, especially floatglass (see "Silikattechnik", 35, 1984, pages 200 to 204, especially Table 3).

In a desirable embodiment of our invention the glass panes are intrinsically prestressed. "Intrinsically Prestressed" means primarily thermal or chemical prestressing which occurs according to proven methods (see German Patent 10 64 207, German Patent 14 21 926; "Glas+Rahmen", 21, 1983, page 1133, "Silikattechnik", 38, 1987, Pages 28 to 30). This prestressing influences positively the character of the glass panes used as flow guide elements in regard to mechanical stresses which occur in the flow ducts for the flue gas to be processed and/or which has been processed in the flue gas-cleaning or cleaning plant.

The glass panes on their lateral edges are held on the walls of the flow duct. Different mechanical aids are provided for this, e.g. grooves, racks, brackets, supports and the like.

If the flow guide elements are specifically self-supporting glass panes, certain details are thereby set, especially in regard to the thickness of the glass panes which are of the minimum value consistent with a self-supporting character.

Surprisingly, all occuring thermal stresses, especially thermal stresses due to temperature variations and thermal stresses which result from the fact that the built-in glass pane can have an inhomogeneous temperature distribution over its surface in operation of a flue gas cleaning unit, can be withstood or taken.

In our invention, the glass panes in the built-in state can be subjected to an additional mechanical compressive precompression, i.e. an external prestress, transverse to the flow which can be accomplished by suitable construction steps. The flow resistance is surprisingly low when the glass panes have a surface roughness of less than a few thousandths of a millimeter, chiefly in the vicinity of the flow guide surfaces. Surprisingly with this kind of surface roughness the danger of growth or deposition of solid materials from the flue gas on the glass surface scarcely exists.

In the flow duct according to our invention, the glass panes which form the flow guide elements can be mounted individually or assembled in a packet or aggregate of flow guide elements which form flow gaps and which can be replaceable as a unit.

The individual glass panes can also be individually replaceable or exchangeable.

Advantageously, the glass panes forming flow gaps are assembled in flow guide element packets and are built into the flow duct in packets so that they are exchangable or replaceable as a packet. In one such flow guide element packet all the glass panes can be the same size or can be formed with increasing radii of curvature, a design which is desirable from the flow engineering view point.

The glass panels can be curved into flow guide elements which for their part have a special aerodynamic shape. By "glass pane" we mean also the socalled united glass panes, i.e. multipane safety glass.

It is an advantage of our invention that with our flow duct which has flow duct guide elements comprising self-supporting glass panels, a practically unlimited operational life is attained. They are characterized by a reduced flow resistance and show hardly any accumulation of solid components which travel with the gas. However, should such an accumulation on the flow guide elements, especially in the flow shielded, flow-shadow or eddy regions, occur, the solid components there can be easily washed away.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
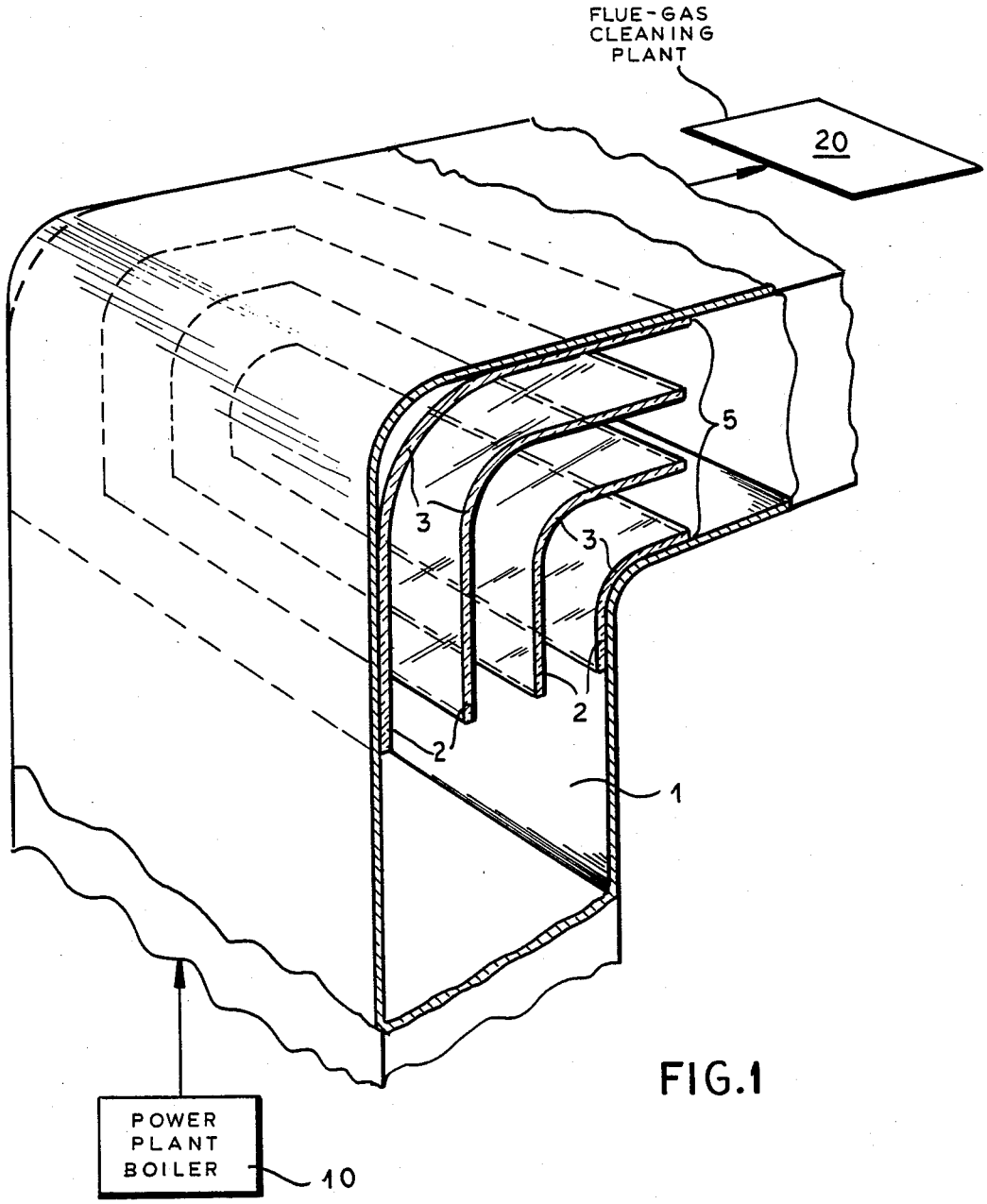
FIG. 1 is a perspective view of an embodiment of a flow duct according to our invention with built-in flow guiding elements with its side wall removed.

The flow duct 1 shown in the drawing guides or conducts flue gas to be treated or which has been treated in an flue gas cleaning plant 20. The flow duct 1 usually is located downstream of a boiler furnace, e.g. a power plant boiler 10.

The flow duct has a rectangular flow cross section and a plurality of flow guide elements 2. In this example, the portion of flow duct 1 shown in the drawing is an elbow or knee of the duct or pipe system and flow guide elements 2 are provided in this region. They have curved flow guide surfaces 3.

The flow guide elements 2 comprise curved glass panes made from glass of the above-mentioned kind or selected from the above-mentioned groups and these flow guide elements 2 are indeed designed to be self-supporting and are built-in. The glass panes 2 are prestressed and, indeed, in such a way as is common with single-pane safety glass panes, especially which are used as motor vehicle windows or windshields.

Figure 2:
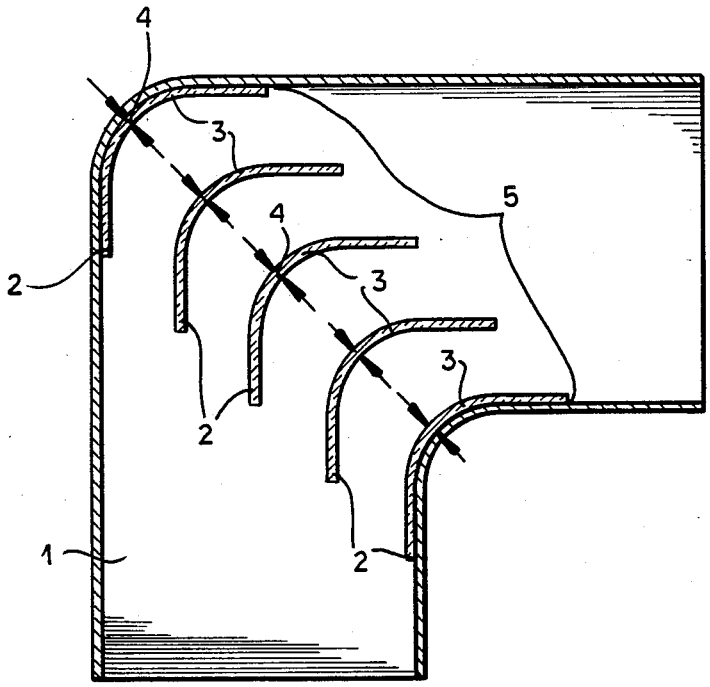
FIG. 2 is a vertical cross-sectional view through another embodiment of a flow duct according to our invention similar to that of FIG. 1.

Additionally, the glass panes are subjected to a mechanical compressive prestress transverse to the flow direction, and by suitably being built-in. In FIG. 2, the double arrows 4 indicate this prestressing.

Although it cannot be observed in the drawing because of the scale chosen, the glass panes have only a very slight surface roughness, in fact, less than a few thousandths of a millimeter.

Figure 3:
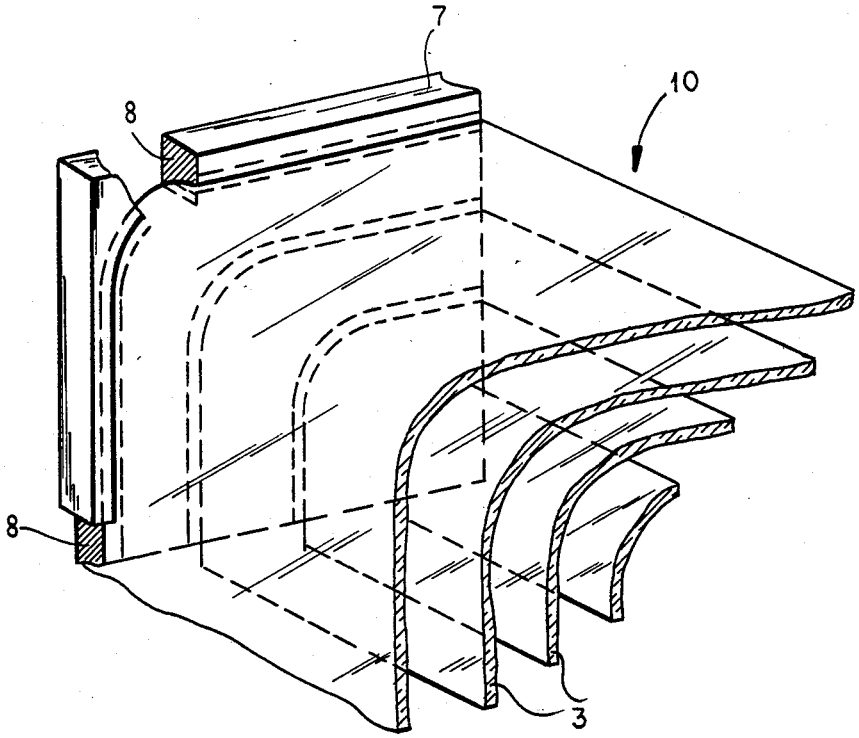
FIG. 3 is a perspective section showing a glass pane packet according to the invention.

In the built-in state, the glass panes 2 of this embodiment form a packet 10 of flow guide elements 3 which provide flow gaps. The holders 7 for the glass panes 2 are appropriately equipped with grooves 8 to receive the elements 3 (FIG. 3). In the example or embodiment according to FIG. 1, the individual glass panes of the flow guide element assembly 5 are of different sizes in the flow direction. In the embodiment according to FIG. 2, all the glass panes 2 of the flow guide element assembly 5 are the same size.

By "a few thousandths of a millimeter" in the following claims, we mean preferably less than a thousandth of a millimeter but always less than five thousandths of a millimeter.

We claim:

1. A flow duct for flue gas of a flue gas cleaning plant, comprising:

a plurality of duct walls defining an elbow connected in said plant to be traversed by a flue gas; and a plurality of arcuately bent self-supporting plate glass flow guide elements disposed in said elbow and defining spaces between them traversed by said flue gas.

2. The flow duct defined in claim 1 wherein said plate glass flow guide elements are intrinsically prestressed.

3. The flow duct defined in claim 1 wherein said plate glass flow guide elements have a mechanical compressive prestress applied to them in a direction traverse to a flow direction of said flue gas.

4. The flow duct defined in claim 1 wherein said plate glass flow guide elements have a surface roughness of less than a few thousandths of a millimeter.

5. The flow duct defined in claim 1 wherein said plate glass flow guide elements are assembled in a packet replaceable as a unit in the duct.

6. The flow duct defined in claim 5 wherein all of said plate glass flow guide element of said packet are of the same size.

* * * * *

UNITED STATES PATENT AND TRADEMARK OFFICE

CERTIFICATE OF CORRECTION

PATENT NO. : 4 919 170

DATED : 24 April 1990

INVENTOR(S) : Dietmar KALLINICH et al.

It is certified that error appears in the above-identified patent and that said Letters Patent is hereby corrected as shown below:

In the Heading:

(Item [75] - Inventors):

The second inventor's name should read

-- Wolfgang KAHLERT -- .

Signed and Sealed this

Fifth Day of March, 1991

*Attest:*

*Attesting Officer*

HARRY F. MANBECK, JR.

*Commissioner of Patents and Trademarks*